United States Patent [19]

Cray

[11] 4,445,665

[45] May 1, 1984

[54] VEHICLE SERVICING LIFT

[76] Inventor: Donald L. Cray, 3737 SE. 36th Pl. Suite 11, Portland, Oreg. 97202

[21] Appl. No.: 362,300

[22] Filed: Mar. 26, 1982

[51] Int. Cl.[3] ..... E02C 3/00

[52] U.S. Cl. ..... 254/88; 254/90; 187/8.43

[58] Field of Search ..... 187/8.41, 8.43, 8.61, 187/8.65, 9 R; 414/508, 678; 297/346, 314; 280/52.6; 254/88, 90, 91

[56] References Cited

U.S. PATENT DOCUMENTS

| | | | |
|---|---|---|---|
| 4,031,982 | 6/1977 | Lindfors | 187/9 R |
| 4,203,575 | 5/1980 | Johnson | 254/88 |
| 4,238,114 | 12/1980 | Migliorati | 187/8.43 |
| 4,306,707 | 12/1981 | Roscoe | 254/47 |

FOREIGN PATENT DOCUMENTS

| | | | |
|---|---|---|---|
| 2250332 | 6/1973 | France | 280/32.6 |
| 245320 | 10/1969 | U.S.S.R. | 187/8.43 |

*Primary Examiner*—Robert C. Watson
*Attorney, Agent, or Firm*—Oliver D. Olson

[57] ABSTRACT

A portable vehicle servicing lift includes a trailerable frame which pivotally mounts a pair of transport wheels arranged to be moved between an extended transporting position and a retracted position in which the frame connected thereto is lowered to the ground or other support surface. The frame also mounts a pair of vehicle ramps adjacent one end by a fixed fulcrum associated with the frame, and at the opposite end by a hydraulic piston-cylinder pivotally interconnecting the ramps and the frame for movement of the ramps about the axis of the pivot fulcrum. The frame includes a pair of trolley rails mounted to the frame between the transport wheels, the trolley rails configured to guidingly support a chair assembly and other equipment associated with automotive repair for movement along the full length of the frame.

7 Claims, 12 Drawing Figures

48
12
32
28
54'
28'
30'
14'
50
30
26'
14
26
52
10
40
24
24'
38
22
16
42
46
54
32
10
46'
42'

48
12
40
36
34
38
32
28
54'
28'
30'
14'
50
30
26
26'
52
24
24'
20
18
16
22
10
32
54
46
46'
42'

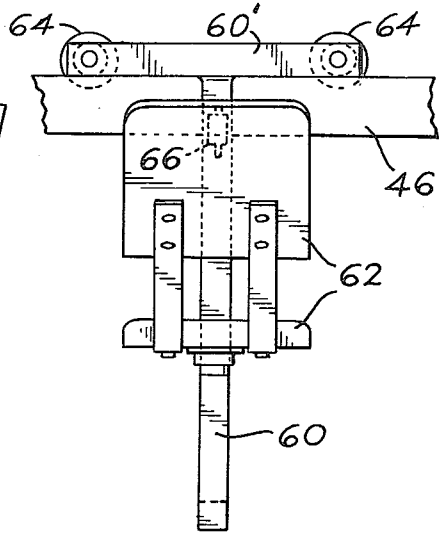
FIG. 7
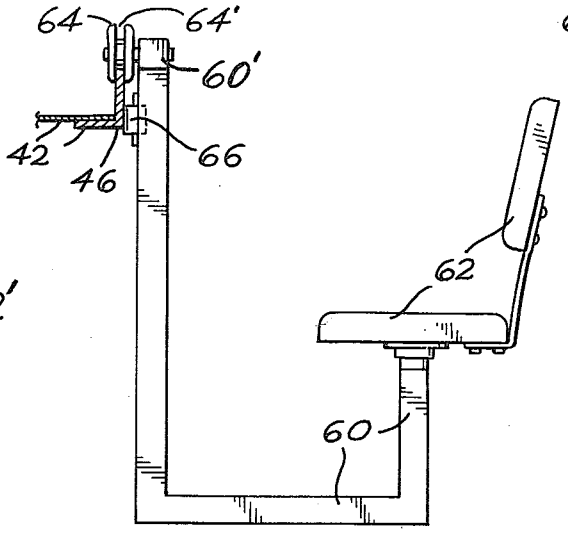
FIG. 6
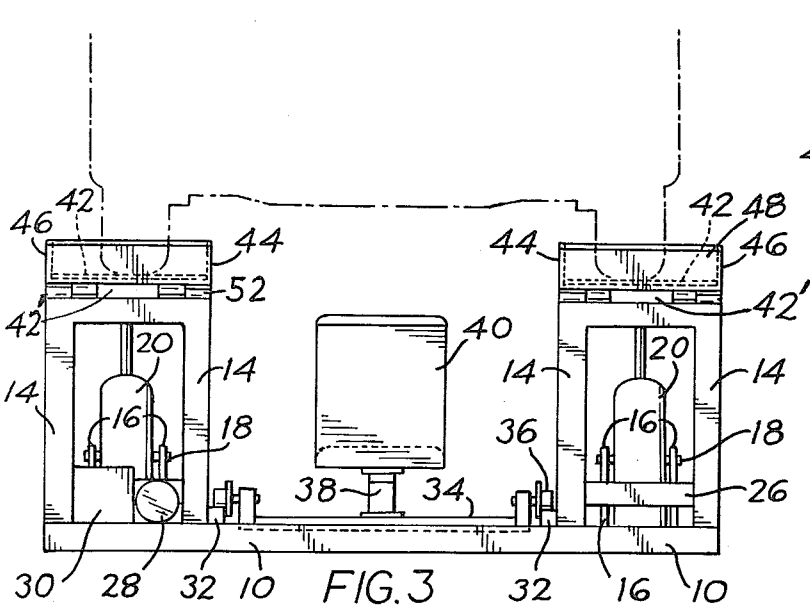
FIG. 3
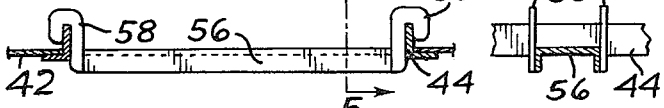
FIG. 4
FIG. 5
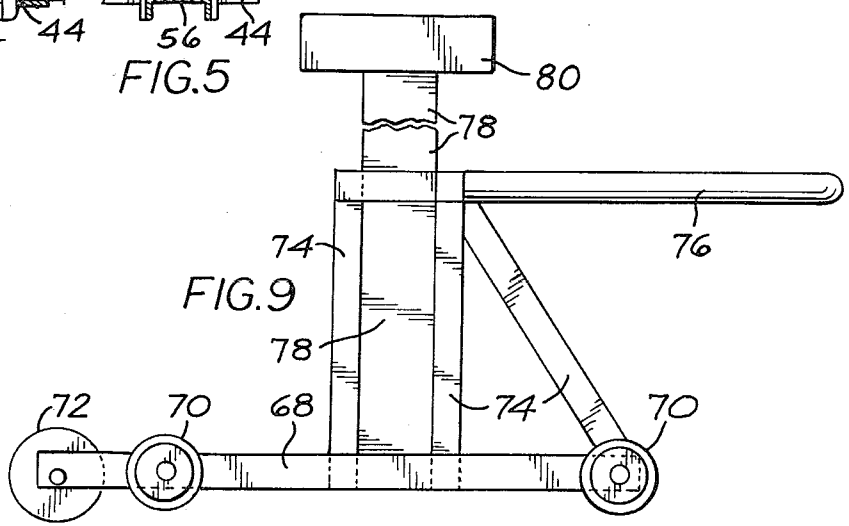
FIG. 9
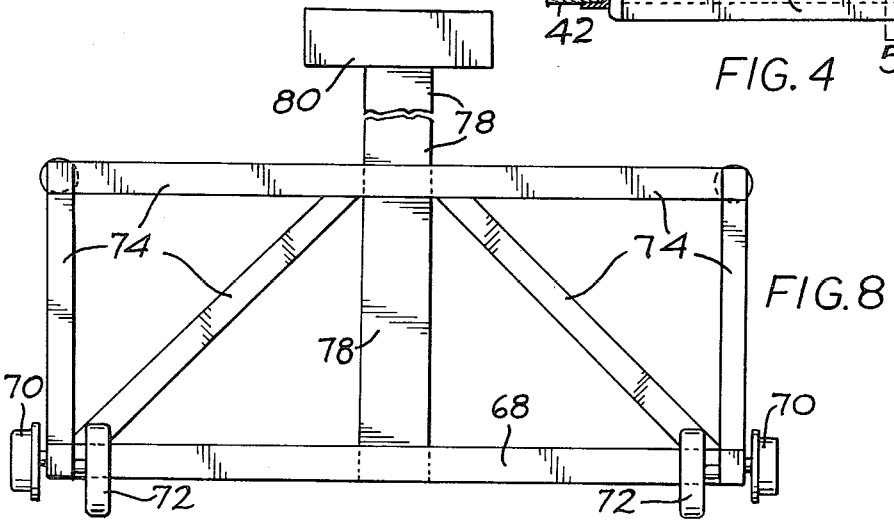
FIG. 8

VEHICLE SERVICING LIFT

BACKGROUND OF THE INVENTION

This invention relates to automobile servicing lifts, and more particularly to portable servicing lifts arranged to be transported to a location where a vehicle may be placed on it and the lift operated to raise the vehicle to a height where servicing may be done to the underside of the vehicle conveniently and efficiently.

It is often desirable and sometimes necessary to service a vehicle at a location other than a garage or automotive shop. However, this is oftentimes difficult or not possible because conventional equipment used in automotive repair is not easily transported, and is seldom functional at remote sites. When servicing requires access to the underside of a car, work in the field becomes significantly difficult, for the vehicle must be raised and equipment for major work provided with unhindered access under the raised vehicle.

U.S. Pat. Nos. 3,693,818; 3,838,783 and 3,931,895 disclose vehicles in the field. U.S. Pat. No. 3,693,818 discloses a trailer frame mounting a rigid framework which is not collapsible and which requires tilting of the entire trailer frame to slope the vehicle ramps for receiving and discharging an automobile. U.S. Pat. No. 3,931,895 discloses a trailerable frame which mounts a pair of complex movable scissors hoist structures connected to both the front and rear ends of a pair of vehicle ramps for raising and lowering both ends of a car placed on the ramps.

U.S. Pat. No. 3,838,783 discloses a portable but complex service lift by which a lift truck or other vehicle may be tilted to a sufficiently severe angle as to expose the underside for access to servicing.

These types of lifts do not provide any form of support by which a person may move with comfort and facility under a vehicle for servicing or repairing components on the underside of the vehicle.

SUMMARY OF THE INVENTION

In its basic concept, this invention provides a portable lift frame mounting for pivotal movement a pair of vehicle support ramps arranged to support a vehicle in elevated position for servicing by a person seated in a chair assembly movable along the length of the frame under the vehicle.

It is by virtue of the foregoing basic concept that the principal objective of this invention is achieved; namely, to overcome the disadvantages and limitations of the lift of the class described in which access to the underside of the vehicle by persons and equipment is virtually unhindered.

Another object of this invention is the provision of a lift of the class described in which transport wheels are mounted for vertical movement relative to the frame for raising and lowering the frame relative to a ground surface.

Another object of this invention is the provision of a lift of the class described in which the transport wheels may be easily and speedily detached to provide for fixed installation of the lift assembly.

Another object of this invention is the provision of a lift of the class described in which its front and rear ends are completely open and free of obstructing frame and lift components which might otherwise restrict access under either end of a vehicle supported on the lift ramps.

A further object of this invention is the provision of a lift of the class described which includes trolley rails extending along the length of the frame between transport wheels, the trolley rails arranged to support a chair assembly and other equipment associated with automotive repair for guided rolling movement under the full length of a vehicle supported on the lift.

Another object of this invention is the provision of the lift of the class described which is arranged to removably mount an external rolling chair assembly for movement along the outside length of the lift assembly for work along the lower outside portions of a vehicle on the lift ramps.

A still further object of this invention is the provision of a lift of the class described which is of simplified construction for economical manufacture, maintenance, repair and operation.

The foregoing and other objects and advantages of this invention will appear from the following detailed description, taken in connection with the accompanying drawings of a preferred embodiment.

BRIEF DESCRIPTION OF THE DRAWINGS

FIG. 3 is an end elevation of the portable lift apparatus of this invention as viewed from the right in FIG. 2.

FIG. 4 is a fragmentary end view of a jack support beam releasably spanning the two vehicle ramps of the lift apparatus of the preceding views.

FIG. 5 is a fragmentary horizontal section taken along the line 5—5 in FIG. 4.

FIG. 6 is a fragmentary side elevation of a removable outer chair assembly engaging the outside plate of one of the vehicle ramps.

FIG. 7 is a fragmentary end elevation of the chair assembly of FIG. 6 as viewed from the right in FIG. 6.

FIG. 8 is a foreshortened end elevation of a transmission jack trolley arranged for cooperation with the rail assembly on the frame of the lift apparatus of FIGS. 1–3.

FIG. 9 is a foreshortened side elevation of the jack trolley in FIG. 8 as viewed from the right in FIG. 8.

DESCRIPTION OF THE PREFERRED EMBODIMENT

Figure 1:
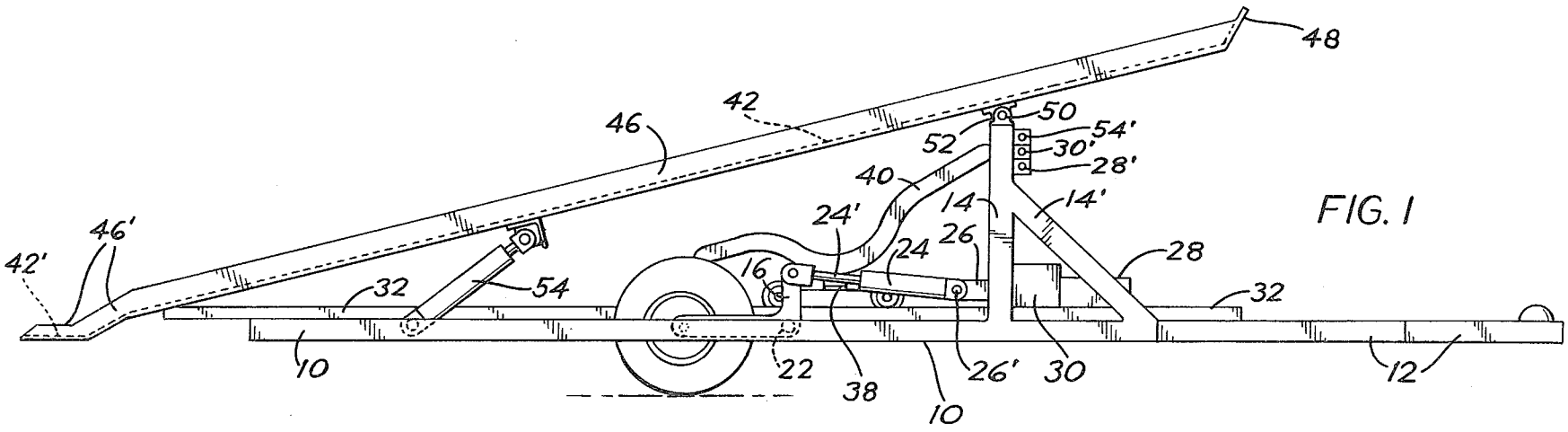
FIG. 1 is a side elevation of portable lift apparatus embodying the features of this invention, the same being shown in collapsed, transporting condition.

FIG. 1 illustrates a trailerable vehicle servicing lift in transporting condition ready for attachment to a towing vehicle. As illustrated, the lift comprises a frame 10 which mounts, adjacent frame tongue and hitch portion 12, a pair of laterally spaced upwardly extending support beams 14. Each is U-shaped in cross section and they are disposed on opposite lateral sides of the frame 10. Reinforcement struts 14' interconnect the support beams 14 and the frame 10 for additional strength of the support beams 14.

Figure 2:
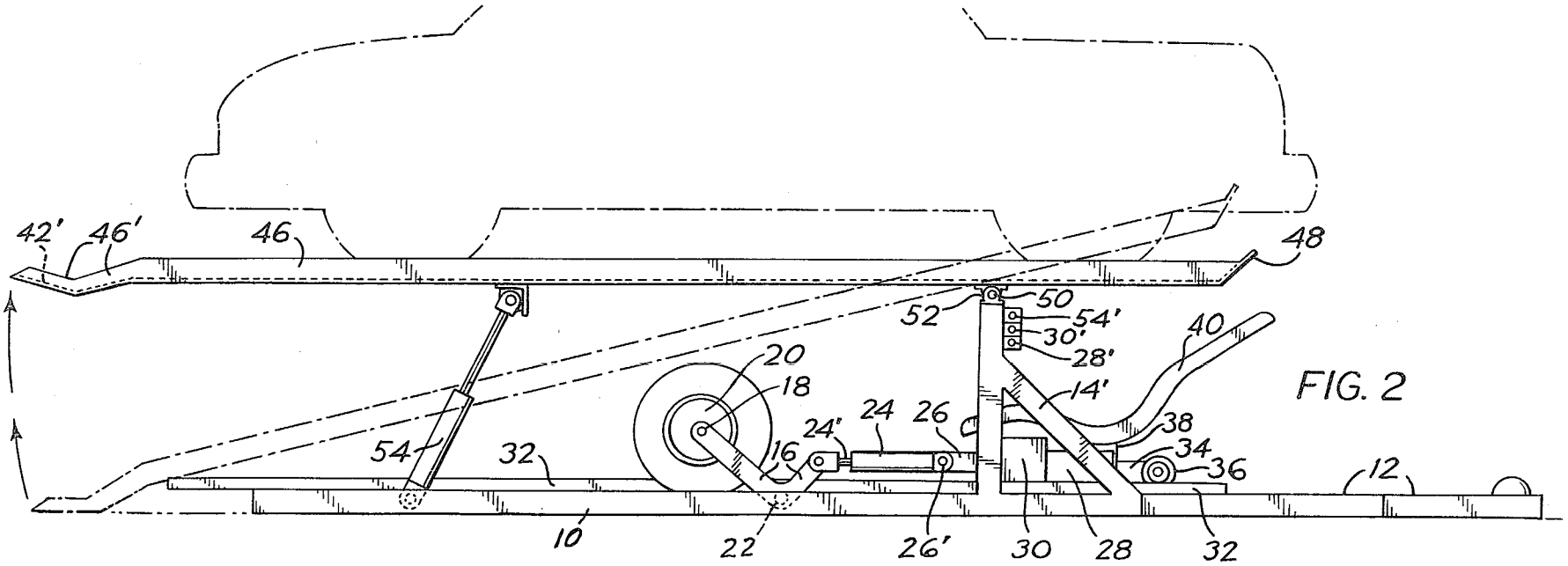
FIG. 2 is a fragmentary side elevation of the lift of FIG. 1 showing the transport wheels retracted and the frame disposed on a ground surface, the ramp piston cylinders having been activated to move the ramps to elevated, horizontal position.

The lift assembly includes retractable transport wheel assemblies which provide means for vertical movement of the framework after the lift has been detached from the towing vehicle. FIG. 1 shows the wheel assemblies having been activated to extend the wheels to a position below the frame for rolling contact with the ground, and FIG. 2 shows the wheel assemblies having been activated to retract the wheels above the bottom side of the frame whereby to lower the latter to the ground.

The wheel assemblies illustrated each comprises a pair of bell cranks 16 one end of which supports a wheel axle 18 configured to receive a wheel 20. Each pair of bell cranks is mounted pivotally to frame 10 by pivot pin 22 supported by the frame. The opposite end of each bell crank pair is connected pivotally to one end, for example the rod end 24' of a piston cylinder 24, the opposite end of which is mounted to the associated support beam 14 as by bracket 26 and pivot pin 26'. The piston cylinder 24 is connected to a conventional motor driven hydraulic pump 28 through control valve 28'. The pump motor is supplied power by battery means 30 through control switch 30'.

Thus, operation of the piston cylinder 24 to extend piston rod 24' outward causes the bell crank 16 to rotate counterclockwise (FIGS. 1 and 2) about its pivot 22 to extend the wheel assembly downward below the frame 10, thereby raising the frame above the ground. Operation of the piston cylinder to retract the piston rod causes the bell crank to rotate in the opposite direction about pivot 22 to retract the wheel assembly upward above the bottom edge of the frame, thereby lowering the frame to the ground surface.

Mounted to the frame between the wheel assemblies is a pair of parallel rails 32 (FIG. 3) extending longitudinally along the frame bed. A chair carriage is arranged with a base 34 configured to mount rail wheels 36 for rolling engagement with rails 32. Mounted centrally to the base member 34 is an upwardly extending pedestal chair mount 38 arranged to receive a chair 40. The chair preferably is of the contour shape illustrated and the pedestal preferably is arranged to mount the chair for rotational and rocking movements. These motions, together with rolling movement of the carriage on the rails 32, allows the head and shoulders of a person to be raised and lowered for most convenient access to work area under both low and high slung chassis.

The lift assembly includes a pair of longitudinally elongated vehicle ramps each comprising a bottom base plate 42, vertically extending inner and outer side walls 44 and 46, respectively, and front stop wall 48. The rear portions 42', 44' and 46' are offset angularly to conform to ground level when in the position of FIG. 1. Each ramp is pivotally mounted adjacent its forward end to the top surface of an associated beam 14 by a pivot shaft 50 journaled in bearings 52. The ramps thus may be moved between the inclined loading position shown in broken lines in FIG. 2 and the horizontal servicing position shown in full lines. The ramps obviously are configured of sufficient length to support a vehicle for servicing.

Means for elevating the rear ends of the ramps is provided. Hydraulic piston cylinder units 54 are pivotally mounted at one end to the frame 10, and at the opposite end to pivot brackets attached to the respective ramps. Each piston cylinder is conventionally connected to the hydraulic pump 28 through control valve 54'. With the cylinders 54 in the retracted position shown in FIG. 1, the ramps are inclined with their rear ends substantially in the plane of the bottom side of the frame. Operating the cylinders 54 to their extended position moves the rear ends of the ramps vertically upward to a height substantially equal to the height of the ramps at the fixed pivot point of shafts 50. Accordingly, the horizontal servicing position illustrated in full lines in FIG. 2 is achieved.

As is apparent in the drawings, the portable vehicle servicing lift of this invention utilizes a structure which is arranged to raise and support a vehicle for servicing only three or four feet above a ground surface. Thus, the complex lifting mechanisms of portable servicing lifts of the prior art which are arranged to raise a vehicle to a height which provides standing access underneath a vehicle is not required. Also, as is apparent in the drawings, both the front and rear ends of the lift assembly are completely open and free of obstructing mechansim and structure, providing for unhindered access to the underside of the vehicle by persons and equipment.

FIGS. 4 through 12 illustrate ancillary equipment configured for removable use with the lift. FIGS. 4 and 5 illustrate a jack support beam arranged to releasably engage the inner side walls 44 of each ramp. The jack support beam includes a strengthened base member 56 configured to span the distance between the two vehicle ramps, and mounted to each longitudinal end thereof is a catch member 58 configured to slidably engage the wall 44 of each ramp, as shown in FIG. 4. The jack support may be mounted on the lift and moved along the ramps to any desired position, whereupon a conventional portable hydraulic jack or scissors jack may be placed thereon to jack up an individual wheel of a vehicle located on the ramp for servicing.

FIGS. 6 and 7 show side and rear views, respectively, of a removable roller chair assembly arranged to be disposed for movement along the outer longitudinal side of the lift. As illustrated, a J-shape frame 60 mounts at one end a chair 62, preferably by a swivel connection. The opposite end of the frame mounts an elongated roller wheel bar 60' which supports a pair of longitudinally spaced wheels 64. Each wheel incorporates a deep annular groove 64' configured to engage the top edge of the outer ramp side wall 46. A stabilizer wheel 66 is mounted to the frame 60 for rolling abutment with the lower portion of wall 46.

This outboard chair arrangement is particularly advantageous for use in performing body and fender work. A person may sit in the chair 62 with legs straddling the frame 60 and feet engaging the ground to effect movement along the outer side of the supporting ramp.

FIGS. 8 and 9 illustrate front and side views, respectively, of a transmission support trolley assembly arranged for association with the rails 32. The trolley framework shown in FIG. 9 comprises a base member 68 which mounts four rail wheels 70. Two larger ground wheels 72 are mounted for rotation on the front end of the trolley base inward of the rail wheels 70. The base mounts an upwardly projecting framework 74 which mounts a pair of rearwardly extending handle members 76. The framework also mounts a vertically extending post 78 which supports a conventional transmission jack illustrated generally by box 80. A typical transmission jack suitable for this purpose is the head component of Model No. 711-50 of Wudel Manufacturing Co., Inc. The trolley may alternatively mount an engine jack, oil drain reservoir, welder, or other desired equipment.

With the trolley wheels 70 in rolling engagement with the rails 32, the trolley may be rolled forward and back longitudinally along the lift frame. By pushing the trolley rearward past the terminal ends of rails 32, the ground wheels 72 come into rolling contact with the ground, and the trolley may be moved about the ground surface by the handles 76, in much the same manner as a wheelbarrow.

Figure 12:
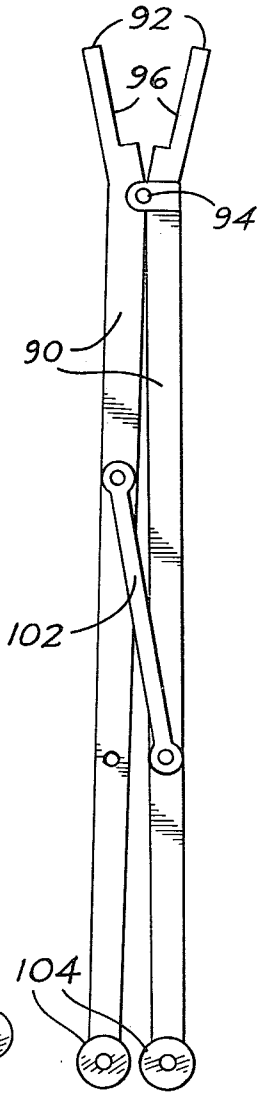
FIG. 12 is a side elevation of the engine hoist assembly similar to FIG. 11 but showing the same in collapsed condition.
Figure 11:
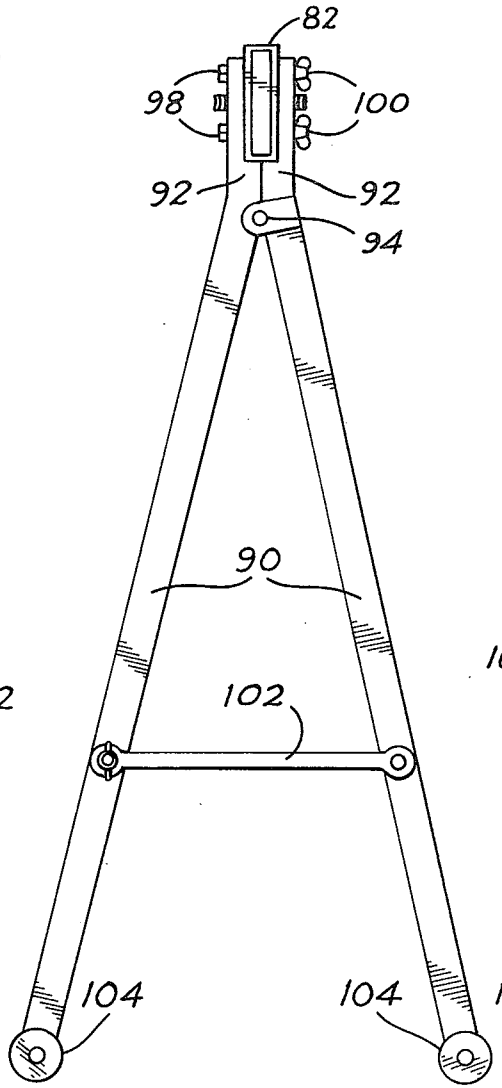
FIG. 11 is a side elevation of the engine hoist assembly as viewed from the right in FIG. 10 the same being shown in operative condition.
Figure 10:
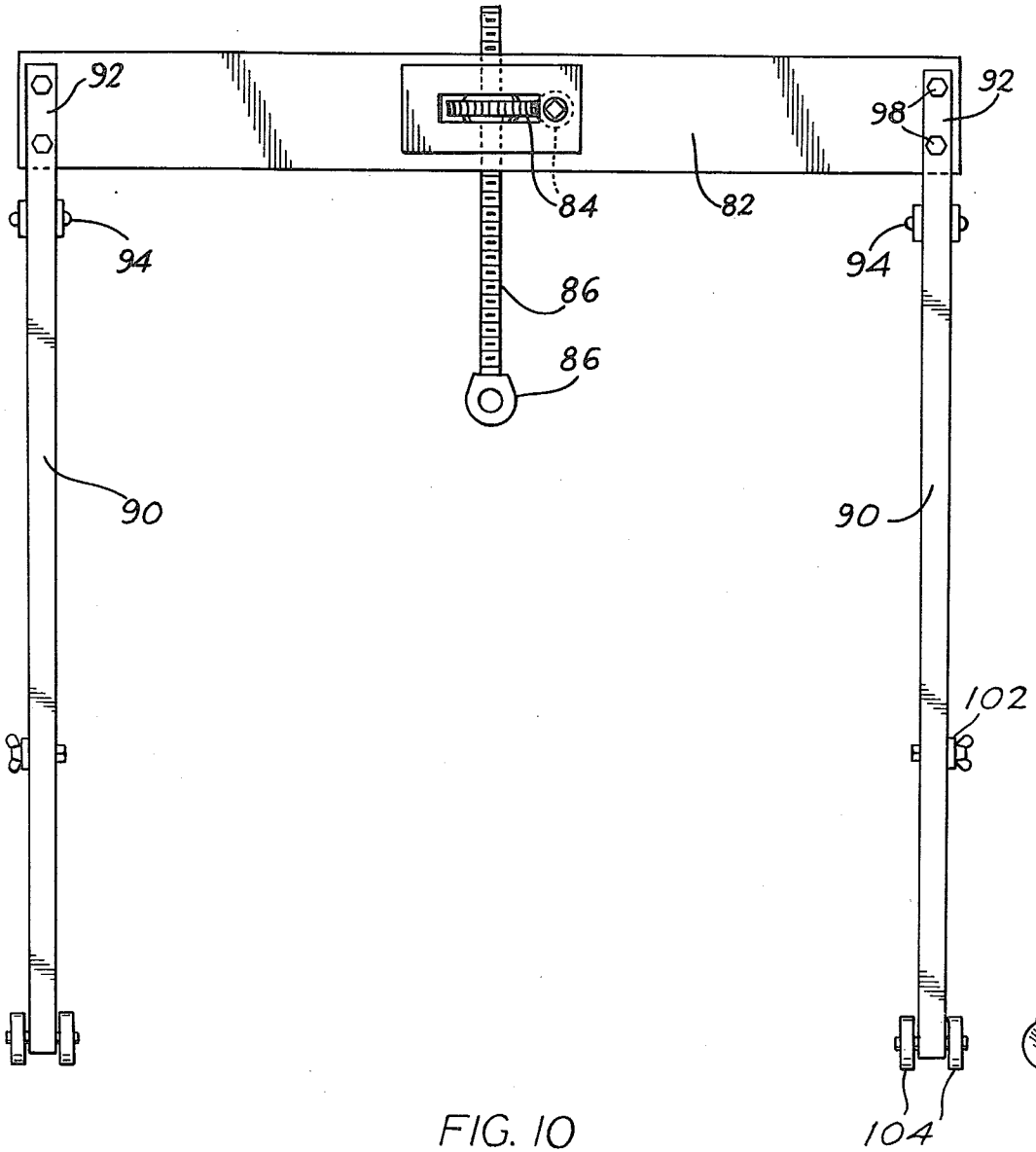
FIG. 10 is a front elevation of a knock-down engine hoist assembly arranged for cooperation with the lift assembly of this invention.

FIGS. 10–12 illustrate an engine hoist assembly which may be used in conjunction with the lift. The engine hoist comprises a main transverse beam 82 which centrally mounts an engine support. As illustrated, the support comprises a gear assembly 84 and a threaded lifting bar 86 fitted with a lifting ring 88 on its lower terminal end. The main beam 82 is configured greater in length than is the width of the lift frame 10, and incorporates, adjacent the longitudinal ends thereof strut mounting bores (not shown). The engine hoist assembly includes a pair of collapsable end struts, each configured as a pair of elongated posts 90 secured together pivotally adjacent their upper end portions 92 by hinge pin 94. End portions 92 are configured with notched portions 96 arranged to receive the main beam 82, as best shown in FIG. 11. Bores (not shown) are provided through the end portions 92 for alignment with the strut mounting bores through the main beam, and bolts 98 and nuts 100 are arranged to removably secure and tighten the end portions 92 and the main beam together. A cross bar 102 is arranged to removably interconnect the lower portions of the strut posts 90 for stability and strength. Ground wheels 104 are mounted to the bottom end of each strut post 90 for rolling movement of the hoist assembly on the ground.

In removing an engine from a vehicle located on the servicing lift ramps with the engine located in the area of the rear ends of the ramps, the engine hoist is assembled by bolting the main beam to each end strut assembly and securing the cross bars 102. The hoist then is rolled into place straddling the rear end of the servicing lift. With the ramps in raised condition and the engine ready for removal, lifting chains are attached between the engine and the ring 88 on the lifting bar 86. The gear winch 84 then may be operated to tension the lifting chains. The hydraulic ramp cylinders 54 may then be operated to gradually lower the ramps, bringing the vehicle down and thus separating the engine from the car. The engine hoist assembly and the separated engine connected thereto may then be rolled away. Installing an engine follows the reverse procedure.

A disabled vehicle may be moved into servicing position up the inclined ramps by any suitable winch mechanism mounted on the lift or on a tow truck, as will be apparent.

By virtue of the simplified construction and the significantly lower construction costs of the lift of this invention, compared with conventional servicing lifts of the prior art, its use as a fixed stationary lift is a garage or automotive repair shop is anticipated. For this purpose the pivot pins 22 and 26' which mount the transport wheel assemblies may be configured as removable pins which, when removed, disengage the bell cranks 16 and the piston cylinders 26 from the lift. In this manner the wheel assembly may be utilized to transport a servicing lift assembly to a permanent location in a garage or repair shop, the wheels retracted and then removed. The wheel assemblies may then be reused to transport other servicing lifts. This arrangement reduces the cost to a buyer when wheel components are not to be used.

The operation of the portable vehicle servicing lift previously described is as follows: The lift assembly is trailered to a servicing site, and is then disconnected from the towing vehicle. The piston cylinders 24 are operated to retract the transport wheels 20 and thus lower the frame onto a ground surface. The vehicle to be serviced is driven or winched up the inclined ramps, and piston cylinders 54 are operated to elevate the ramps into horizontal servicing position. A person then may sit in the chair 40 and push the chair carriage along the rails 32 beneath the underside of the vehicle to the location where service is to be made. The equipment associated with the lift assembly described above may be used as discussed previously. When servicing is completed the loading procedure is reversed, the transport wheels extended to lowered position, the lift reattached to the tow vehicle, and is then trailered away.

From the foregoing it is clear that the lift of this invention utilizes a structure which includes a frame that mounts a pair of vehicle ramps adjacent one end for pivotal movement about the axis of a fixed pivot fulcrum by extensible power means interengaging the frame and the ramps adjacent the opposite end. The frame is arranged to be vertically movable relative to a ground surface by retractable wheels and includes apparatus by which servicing to the under side of a vehicle may be done by a person seated in chair provided for longitudinal movement on rails on the frame underneath the vehicle.

It will be apparent to those skilled in the art that various changes other than those discussed may be made in the size, shape, type, number and arrangement of parts described hereinbefore without departing from the spirit of this invention and the scope of the appended claims.

Having thus described my invention and the manner in which it may be used, I claim:

1. A vehicle servicing lift, comprising:

(a) a frame, (b) a pair of laterally spaced vehicle support ramps each mounted at its forward portion to an elevated fixed pivot associated with the forward end of said frame, the ramps configured to extend rearwardly therefrom a spaced distance beyond the rear end of the frame, (c) elevating means interconnecting the rear portions of the ramps and the frame for pivoting the ramps about the axis of said fixed pivot, (d) carriage rail means mounted longitudinally on the frame below the level of the fixed pivot axis of the ramps, the rail means disposed on the frame centrally under the ramps, and (e) a chair and chair support carriage assembly arranged for removable mounting on the carriage rail means for movement of the chair and carriage assembly longitudinally along the length of the frame centrally under said ramps for supporting a vehicle servicing person in the chair for movement longitudinally under a vehicle.

2. The lift of claim 1 including a pair of transport wheel assemblies mounted pivotally on the frame, power means interengaging the wheel assemblies and frame for extending and retracting the wheel assemblies for vertical movement of said frame relative to ground surface and for releasably securing said wheel assemblies in extended position for transport, and a trailering tongue assembly mounted on the frame for attachment to a towing vehicle for trailering transport.

3. The lift of claim 1 including an equipment mounting trolley with rail wheels configured for removable support upon said rail means, the equipment trolley being arranged to mount automotive component support and maintenance and repair equipment for longitudinal movement along the rail means under the ramps.

4. The lift of claim 3 wherein said equipment mounting trolley additionally includes ground wheels and handle means arranged to support the equipment trolley for movement over a ground surface.

5. The lift of claim 1 including removable jack support means configured as an elongated beam member arranged to extend laterally across the lift assembly between the two vehicle ramps, and catch means mounted to the ends of the beam member configured to releasably engage each ramp for securing the jack support in desired position longitudinally along the ramps.

6. The lift of claim 1 including a chair assembly arranged to engage the outer side only of one of the ramps for movement along the outer side of the ramp.

7. The lift of claim 1 including a portable end collapsible engine hoist assembly comprising a frame configured to laterally straddle the rear portion of the lift ramps a spaced distance above the ramps in elevated position, and adjustable engine connecting means on the frame arranged to be attached to an engine for supporting the latter from the frame when the ramps are lowered, the frame comprising a pair of collapsible end struts and a main transverse beam detachably interconnecting the struts at one end thereof, each strut including a pair of elongated posts secured together pivotally adjacent the main beam for movement of the ends opposite the main beam between an operative position spread apart for supporting the main beam in elevated position and a collapsed position closely adjacent each other, a cross bar releasably securing the posts of each pair in said spaced apart operative position, a roller mounted on the end of each post opposite the main beam for rolling the hoist assembly over an underlying floor, and the engine connecting means is mounted centrally on the main beam.

* * * * *

UNITED STATES PATENT AND TRADEMARK OFFICE

CERTIFICATE OF CORRECTION

PATENT NO. : 4,445,665

DATED : 1 May 1984

INVENTOR(S) : Donald L. Cray

It is certified that error appears in the above-identified patent and that said Letters Patent are hereby corrected as shown below:

Column 1, line 53, "of the lift" should read:
--of the above described prior art.
Another object of this invention
is the provision of a lift--.

Column 2, line 11, "the" should read:--a--.

Column 8, line 4, "end" should read:--and--.

Signed and Sealed this

*Eleventh* Day of *September 1984*

[SEAL]

*Attest:*

GERALD J. MOSSINGHOFF

*Attesting Officer*

*Commissioner of Patents and Trademarks*